US006230794B1

(12) United States Patent
Bertilsson

(10) Patent No.: US 6,230,794 B1
(45) Date of Patent: May 15, 2001

(54) METHOD OF PRODUCING HEAT TRANSFER PLATES; AN ASSORTMENT OF HEAT TRANSFER PLATES; AND A PLATE HEAT EXCHANGER COMPRISING HEAT TRANSFER PLATES INCLUDED IN THE ASSORTMENT

(75) Inventor: Klas Bertilsson, Eslöv (SE)

(73) Assignee: Alfa Laval AB, Tumba (SE)

( * ) Notice: Subject to any disclaimer, the term of this patent is extended or adjusted under 35 U.S.C. 154(b) by 0 days.

(21) Appl. No.: 09/367,403

(22) PCT Filed: Feb. 12, 1998

(86) PCT No.: PCT/SE98/00243

§ 371 Date: Oct. 13, 1999

§ 102(e) Date: Oct. 13, 1999

(87) PCT Pub. No.: WO98/35770

PCT Pub. Date: Aug. 20, 1998

(30) Foreign Application Priority Data

Feb. 14, 1997 (SE) ..... 9700518

(51) Int. Cl.[7] ..... F28D 9/00
(52) U.S. Cl. ..... 165/167; 29/890.039; 165/174
(58) Field of Search ..... 165/146, 153, 165/174, 167; 29/890.039

(56) References Cited

U.S. PATENT DOCUMENTS 4,301,864 11/1981 Kivikas et al. ..... 165/167
5,385,204 1/1995 Boardman et al. ..... 165/170
5,443,115 * 8/1995 Pedersen et al. ..... 165/70
5,462,113 * 10/1995 Wand ..... 165/167
5,979,544 * 11/1999 Inoue ..... 165/153

FOREIGN PATENT DOCUMENTS 0 088 316 9/1983 (EP) .
1 211 065 11/1970 (GB) .
8702608 6/1987 (SE) .

* cited by examiner

*Primary Examiner*—Allen Flanigan
(74) *Attorney, Agent, or Firm*—Fish & Richardson P.C.

(57) ABSTRACT

In a plate heat exchanger heat transfer plates abut against each other in such a way that heat transfer passages are formed therebetween, port holes provided in the heat transfer plates forming port channels through the plate heat exchanger. Between the heat transfer portion (15) of a heat transfer plate (2) and a port hole (14) forming a part of a port channel, that constitutes an inlet for a refrigerant, the heat transfer plate (2) has a passage portion (16). The passage portion (16) is adapted to delimit a distribution passage between the heat transfer plate (2) and an adjacent heat transfer plate, through which distribution passage the refrigerant is intended to flow from the inlet port channel to the heat transfer passage between the heat transfer plates. In the distribution passages the refrigerant shall be subjected to a pressure drop. According to the invention the pressure drop can be given different magnitudes by punching of different kinds of port holes (14) in the heat transfer plates.

15 Claims, 4 Drawing Sheets

METHOD OF PRODUCING HEAT TRANSFER PLATES; AN ASSORTMENT OF HEAT TRANSFER PLATES; AND A PLATE HEAT EXCHANGER COMPRISING HEAT TRANSFER PLATES INCLUDED IN THE ASSORTMENT

FIELD OF THE INVENTION

The present invention concerns a method of producing heat transfer plates, which are of the same size and have central heat transfer portions of the same shape. Each of the heat transfer plates has on respective sides of the heat transfer portion through holes, so called port holes, for through flow of at least one heat exchange fluid. Additionally each heat transfer plate has a passage portion which, when the heat transfer plate abuts against another heat transfer plate in a plate heat exchanger, is adapted to delimit a distribution passage for through flow of said heat exchange fluid. The passage portion extends from one of said port holes to an area in or near said heat transfer portion, which area has the same position in relation to the heat transfer portion in the different heat transfer plates. During production of the heat transfer plates separate operations are carried out for pressing the passage portions of the heat transfer plates and for punching the holes which shall form said port holes, respectively.

BACKGROUND OF THE INVENTION

In a plate heat exchanger heat transfer plates abut against each other in a way such that they form a plate package with heat transfer passages between the heat transfer plates. The port holes of the heat transfer plates form port channels through the plate package.

Plate heat exchangers are often used as evaporators in cooling systems. In such a plate heat exchanger most often at least one heat exchange fluid, which is constituted by a refrigerant, flows into one of the port channels in the form of a liquid-gas mixture. From the port channel the refrigerant is conducted through inlet or distribution passages, of the kind initially mentioned, into the heat transfer passages intended for the refrigerant. When flowing through the distribution passages the refrigerant is subjected to a substantial pressure drop, whereby as nearly even a distribution of the refrigerant between the different heat transfer passages as possible is achieved. In the heat transfer passages the refrigerant evaporates by absorbing heat from another heat exchange fluid flowing through adjacent heat transfer passages.

In the past only a few rather similar refrigerants have been used in most cooling systems. Plate heat exchangers for such cooling systems have been produced in several different sizes, but plate heat exchangers of the same size have normally been given a uniform design, irrespective of the refrigerant to be used in them. Thus, the distribution passages have had the same dimensions in all plate heat exchangers of a specific size, which has meant that the pressure drop to which a refrigerant has been subjected in the distribution passages has not necessarily been optimal for this particular refrigerant.

As a consequence of old environmentally dangerous refrigerants, having been forbidden and a large number of new more environmentally friendly refrigerants having been introduced, a need has arisen for adaptation of the pressure drop in the distribution passages individually for each plate heat exchanger with regard to the refrigerant to be used in it. The new refrigerants, in other words, show large individual differences between their evaporation pressures at a specific temperature.

SE 8702608-4 shows a plate heat exchanger formed with restrictions, which are adapted to reduce the pressure of a refrigerant, when it flows from a port channel into a number of heat transfer passages. The restrictions can be constituted by holes drilled in rings, which are arranged between the heat transfer plates around the port channel, or by holes drilled in a pipe, which is arranged in the port channel constituting the inlet channel for the refrigerant. According to a further embodiment the heat transfer plates may abut against each other two by two around the port holes forming the inlet channel for the refrigerant, except in limited areas where inlet passages have been left. The restrictions can be adapted to a certain refrigerant, a certain pressure drop and a certain temperature difference.

SUMMARY OF THE INVENTION

The object of the present invention is to produce, in a simple and cost effective way, heat transfer plates of the initially described kind, which are intended for plate heat exchangers of different kinds with respect to the pressure drop that is to be attained in their distribution passages.

This object can be achieved, by means of the initially mentioned method of producing heat transfer plates, by providing by said punching operation each one of separate or interconnected sheet metal pieces, which are to form the said heat transfer plates, with holes in a way such that the one port hole in a first sheet metal piece is of a different kind than the corresponding port hole in a second sheet metal piece, the respective port holes of the sheet metal pieces being shaped by the punching operation such that they result in finished heat transfer plates having differently sized passage portions.

By the invention heat transfer plates for plate heat exchangers, which are individually adapted for different refrigerants, can be produced at almost the same cost as heat transfer plates for plate heat exchangers, which are not individually adapted for different refrigerants. The invention contemplates that different punching tools are used for the punching of port holes of different kinds. However, the increase in cost for each heat transfer plate, as a consequence of this, will be marginal in connection with a large production series.

Either the punching operation for punching said port hole can be performed before the pressing operation for the shaping of the passage portions, or the two operations can be performed in the inverse order.

The port holes of different kinds can be shaped as circles but with different diameters; alternatively they can be given a shape differing from a circular shape. In these different ways the heat transfer plates can easily be provided with differently sized passage portions.

Normally the heat transfer portion of a heat transfer plate is provided with a pressing pattern of depressions and elevations by a pressing operation. It is convenient to shape the passage portion of the heat transfer plate in the same pressing operation.

In a preferred way of carrying out the method according to the invention the passage portion of each of the heat transfer plates is shaped so that it forms a groove. Thus, a distribution passage between two adjacent plates in a plate heat exchanger will be given the shape of a channel having a specific uniform through flow area. It is easy to calculate which length such a channel should have for obtaining of the desired pressure drop in a refrigerant flowing through the channel.

The passage portion can alternatively be provided with a pressing pattern of elevations and/or depressions.

The invention also concerns an assortment of heat transfer plates, which are of the same size and have central heat transfer portions of the same shape. Each of the heat transfer plates has through holes, so called port holes, on the respective sides of its heat transfer portion for through flow of at least one heat exchange fluid and one passage portion which, when the heat transfer plate abuts against another heat transfer plate in a plate heat exchanger, is adapted to delimit a distribution passage for through flow of the heat exchange fluid. The passage portion extends from one of the port holes to an area in or near the heat transfer portion, which area has the same position in relation to the heat transfer portion in each of the different heat transfer plates.

The heat transfer plates of the assortment are characterized in that their port holes at the respective passage portions are of different kinds and shaped such that the passage portions of the heat transfer plates have different sizes.

The phrase an assortment of heat transfer plates, when used here, should be understood to mean at least two different kinds of heat transfer plates. In a plate heat exchanger comprising heat transfer plates from the assortment according to the invention, either heat transfer plates of one kind or heat transfer plates of two or several kinds can be included. The latter alternative can be suitable if the plate package of the plate heat exchanger comprises many heat transfer plates and, thus, long port channels. In such long port channels the heat exchange fluids are subjected to pressure drop. In order to obtain in this case an equal distribution of the refrigerant between the heat transfer passages the distribution passages, thus, may have to be differently sized along the port channel forming an inlet of the plate heat exchanger.

Finally, the invention also concerns a plate heat exchanger comprising heat transfer plates of at least one kind included in the above discussed assortment. A plate heat exchanger of this kind is characterized in that the relationship between the smallest through flow area of a distribution passage and the through flow area of port hole is between 0.0002 and 0.05, preferably between 0.0007 and 0.017. These relationships as a rule are relevant for plate heat exchangers used as evaporators in cooling systems.

BRIEF DESCRIPTION OF THE DRAWINGS

The invention will now be described more closely with reference to the accompanying drawings, in which.

DETAILED DESCRIPTION

Figure 1:
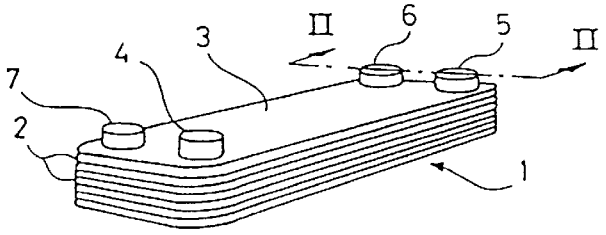
FIG. 1 shows a brazed plate heat exchanger and FIG. 2 shows a section along the line II—II through the brazed plate heat exchanger in FIG. 1.

FIG. 1 shows a plate heat exchanger 1 designed to be used as an evaporator in a cooling system. The plate heat exchanger 1 comprises heat transfer plates 2, which are provided with pressing patterns of elevations and depressions and are brazed together to form a plate package. The heat transfer plates 2 abut against each other such that a first and a second set of heat transfer passages are formed between the heat transfer plates 2 for through flow of two heat exchange fluids. Onto each one of the two outer heat transfer plates of the plate package an end plate is brazed. One such end plate 3 is provided with four connection pipes 4–7.

Every heat transfer plate 2 is provided with four port holes, each in line with one of the connection pipes 4–7, respectively. The port holes in the heat transfer plates 2 form four port channels through the plate package. Two of the port channels, aligned with the connection pipes 4 and 5, communicate with the first set of heat transfer passages and the other two port channels, which are aligned with the connection pipes 6 and 7, respectively, communicate with the second set of heat transfer passages. One of the heat exchange fluids is constituted by a refrigerant, which is intended to flow through the first set of heat transfer passages of the heat exchanger from the connection pipe 4 to the connection pipe 5. Consequently, the second heat exchange fluid is intended to flow through the second set of heat transfer passages of the plate heat exchanger 1, suitably from the connection pipe 6 to the connection pipe 7.

Figure 2:
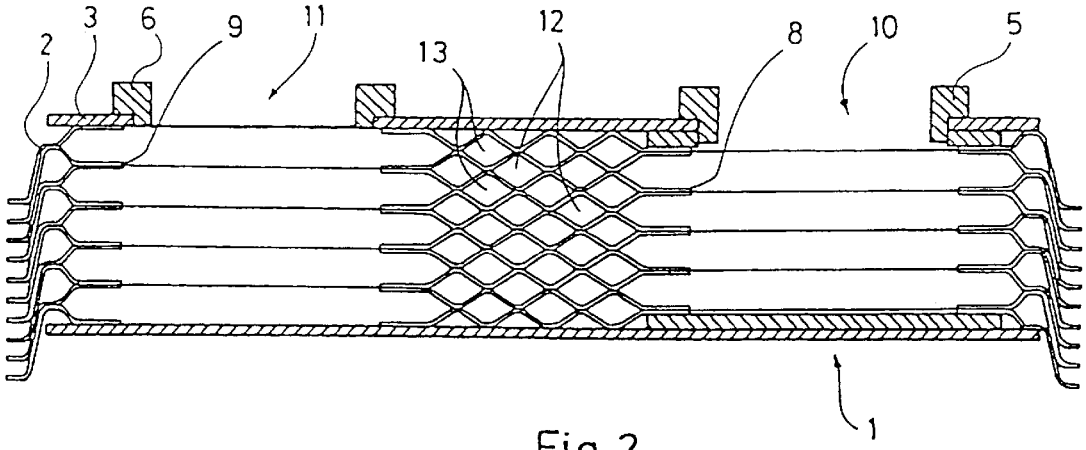

FIG. 2 shows a section through a plate heat exchanger 1 along the line II—II in FIG. 1. The heat transfer plates 2 abut against each other in pairs around two 8, 9 of their port holes, forming two port channels 10 and 11, respectively, and delimiting said first and second sets of heat transfer passages 12, 13. The port channel 10 and the connection pipe 5 form an outlet for the said refrigerant and are connected with the first set of heat transfer passages 12. The connection pipe 6 and the port channel 11 form an inlet for the second heat exchange fluid and are connected with the second set of heat transfer passages 13.

Figure 3:
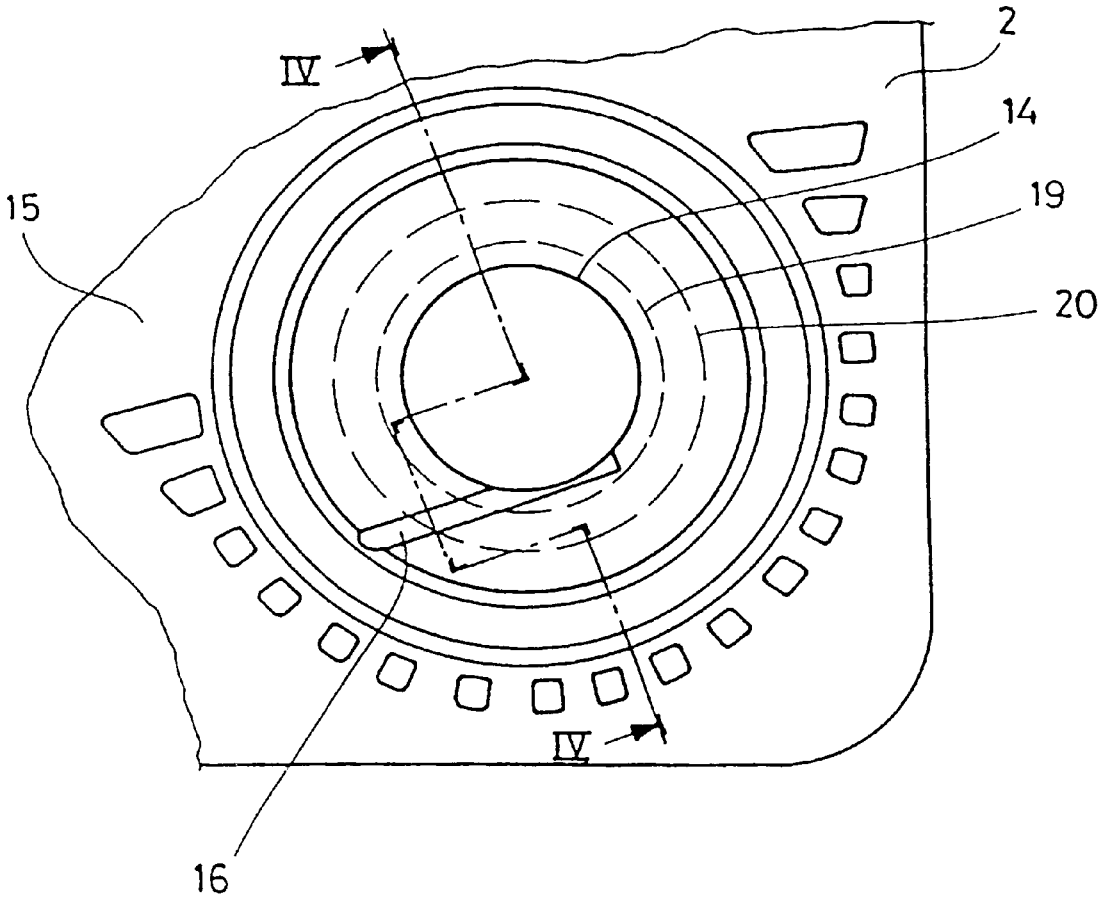
FIGS. 3, 5, 7 and 8 show corners of heat transfer plates having port portions according to different embodiments of the invention. Only the port portions of the heat transfer plates are correctly presented with respect to their function in FIGS. 3, 5, 7 and 8, whereas the remaining plate portions are only schematically shown.

FIG. 3 shows a corner portion of a heat transfer plate 2 according to a preferred embodiment of the invention. In the corner portion the heat transfer plate 2 is provided with a port hole 14 which is aligned with the connection pipe 4 in FIG. 1. When several heat transfer plates 2 abut against each other in a plate package, the port holes 14 of the heat transfer plates 2 form the port channel which together with the connection pipe 4 form the inlet for the refrigerant into the plate heat exchanger. Between the port hole 14 in each heat transfer plate 2 and a heat transfer portion 15 thereof there is a passage portion in the form of a pressed groove 16.

Figure 4:
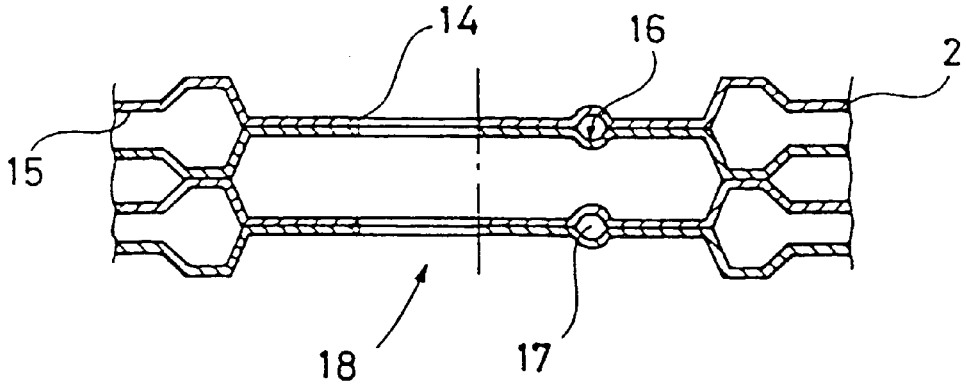
FIGS. 4 and 6 show sections through the heat transfer plates of FIGS. 3 and 5, respectively.

FIG. 4 shows a section through four heat transfer plates 2 along the line IV—IV in FIG. 3. The heat transfer plates 2 abut in pairs against each other around the port holes 14, the pressed grooves 16 of the heat transfer plates of each such pair forming a distribution passage in the shape of a channel 17. The port holes 14 form together a port channel 18. By punching differently sized port holes 14 in the heat transfer plates 2, for example along any of the lines 19, 20 in FIG. 3, different lengths for the distribution passage, i.e. the channel 17, can be accomplished.

When the refrigerant flows via the channels 17 from the port channel 18 into the heat transfer passages 12 formed between the heat transfer portions 15 of the heat transfer plates 2, the refrigerant is subjected to a pressure drop which is dependent on the length of the channels 17. By adaptation of the length of the channels 17 a desired pressure drop and, thus, an optimal evaporation of a specific refrigerant can be obtained.

Figure 5:
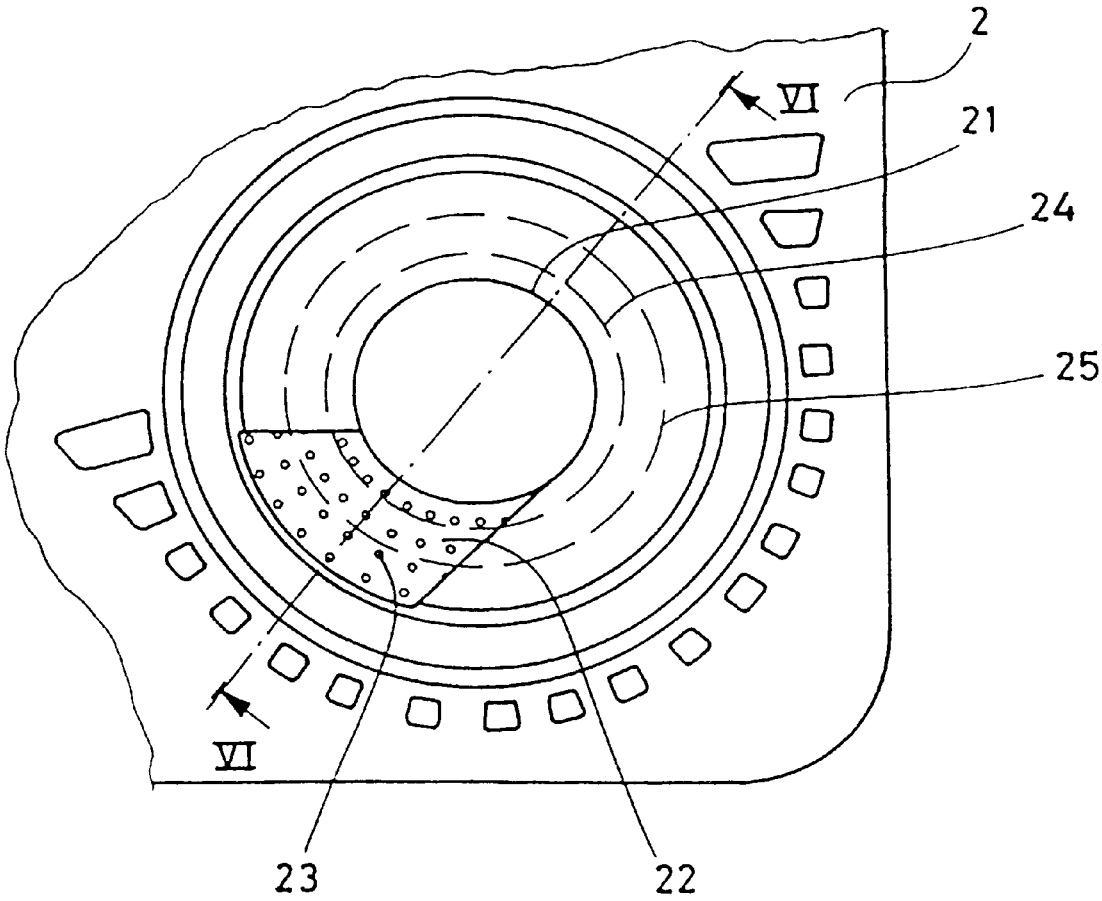

FIG. 5 shows the corner portion of a heat transfer plate 2 according to another embodiment of the invention. The heat transfer plate 2 has a port hole 21, which together with corresponding port holes in other heat transfer plates 2 in a plate heat exchanger, wherein it is included, form the inlet channel of the refrigerant. According to this embodiment of the invention a passage portion 22 of the heat transfer plate 2 by pressing has been provided with a pattern of elevations and depressions 23. Dotted lines 24, 25 mark punching lines along which the port hole can be punched and thus be given different diameters.

Figure 6:
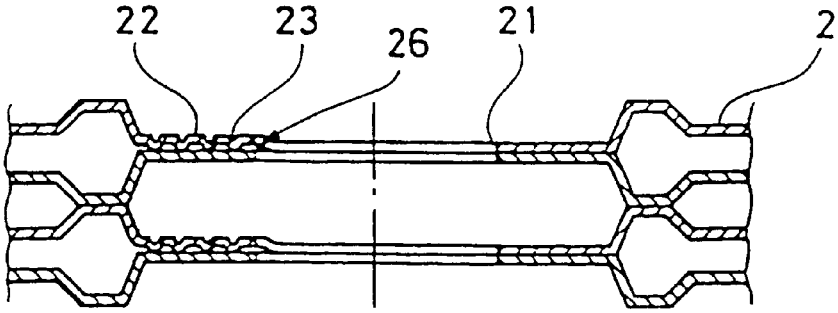

FIG. 6 shows a section through four heat transfer plates 2 along the line VI—VI in FIG. 5. However, only every second heat transfer plate 2 is provided with elevations and depressions 23 in its passage portion. The heat transfer plates 2 abut tightly against each other in pairs around the ports 21 except near the passage portions, where the abutment between the heat transfer plates 2 is such that a distribution passage 26 is formed between the heat transfer plates 2. The length of the distribution passage 26 can be shortened by enlargement of the diameter of the port hole 21.

Figure 7:
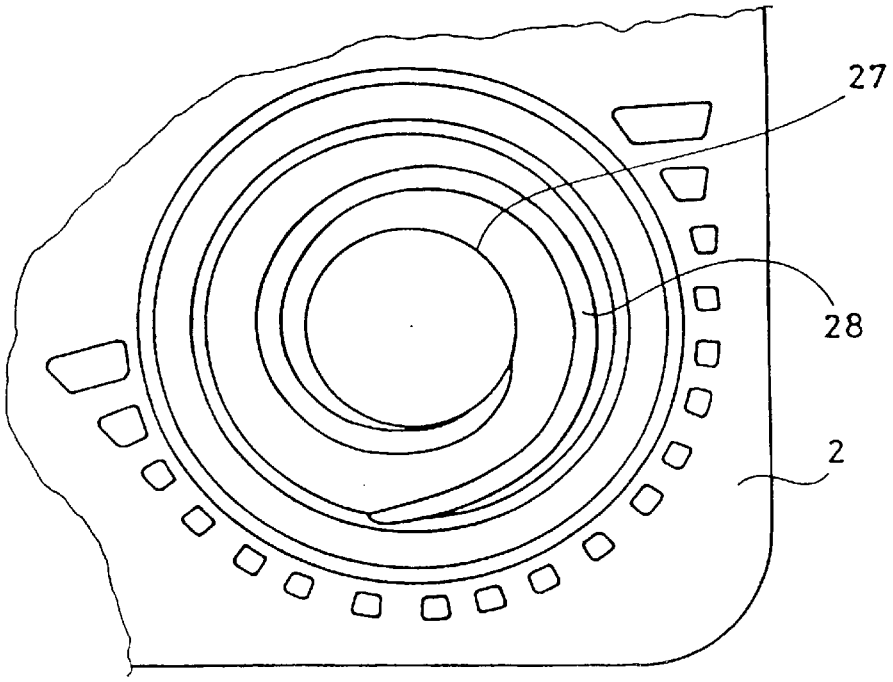

A further embodiment of the invention is shown in FIG. 7. The area around the port hole 27 of a heat transfer plate 2 is here provided with a passage portion, in which a helically shaped groove 28 is pressed. Also in this embodiment the length of the groove 28 can be reduced by enlargement of the diameter of the port hole 27.

Figure 8:
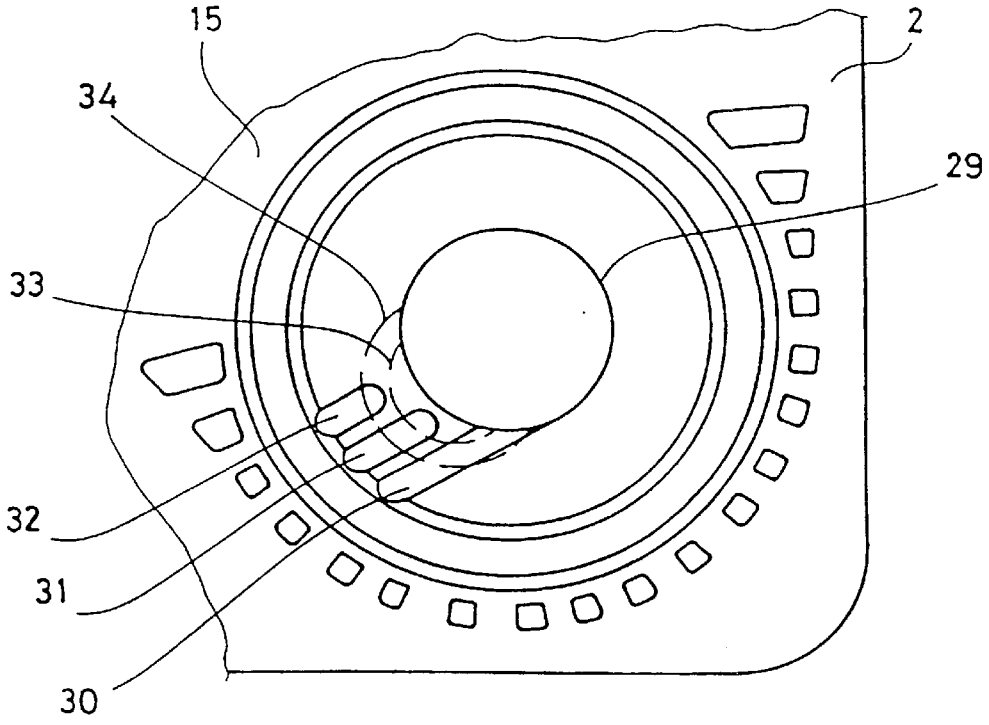

FIG. 8 shows a corner portion of a heat transfer plate 2 according to yet another embodiment of the invention. The passage portion between a port hole 29 and the heat transfer portion 15 of the heat transfer plate 2 is provided with three pressed grooves 30, 31, 32 of different lengths. When the heat transfer plate 2, around the port hole 29, abuts against another heat transfer plate, which has a port hole of the same size, only the groove 30 will form a channel between the edge of the port hole 29 and the heat transfer portion 15. Upon punching out a part of the heat transfer plate 2 along lines 33 and 34, respectively, also the groove 31 and the grooves 31 and 32, respectively, will form channels between the edge of the port hole and the heat transfer portion 15. The more open channels are created the less pressure drop the refrigerant will be subjected to when it flows from the port hole to the heat transfer portion 15.

Many more embodiments of the invention are possible. E.g. all the heat transfer plates 2 shown in FIG. 6 could be provided with elevations and depressions 23 in their passage portions 22, and in the embodiment shown in FIG. 4 only every second heat transfer plate 2 would need to be provided with a pressed groove 16. In the embodiments according to FIG. 3 and 4, and FIG. 5 and 6, the length of the channel 17 and the distribution passage 26, respectively, could be changed by punching out a part of the heat transfer plates 2 in the way shown by the lines 33 and 34 in FIG. 8, instead of by enlargement of the diameter of the port holes 14 and 21, respectively. The plate heat exchanger 1 shown in FIG. 1 could be designed for so called diagonal flow, i.e. the refrigerant would be intended to flow through the plate heat exchanger 1 from the connection pipe 4 to the connection pipe 6, and the other heat exchange fluid would be intended to flow through the plate heat exchanger between the connection pipes 5 and 7.

It has been suggested above that different kinds of port holes should be shaped in heat transfer plates, the passage portions of which are provided with grooves or other irregularities, for achievement of distribution passages giving different through flow resistance. Within the scope of the invention it is possible, however, to achieve this by instead shaping different kinds of port holes, e.g. port holes of different sizes or different shapes, in heat transfer plates having completely smooth passage portions. Thus, for example the plates 2 shown in FIG. 6, which have no elevations or depressions 23 in their passage portions, may be provided with larger port holes than the plates 2, which have such elevations and depressions 23. Also in this way the distribution passages in question can be given a smaller through flow resistance than they have with the shape of the port holes in the heat transfer plates as shown in FIG. 6. In other words, if two adjacent heat transfer plates are of different kinds with respect to the design of their passage portions, as in FIG. 6, the through flow resistance, which is given by the distribution passage formed between the heat transfer plates, can be changed by either one or the other—or both—of the heat transfer plates being provided with larger port holes or port holes of a different kind.

The heat transfer plates 2 according to the invention can be produced from either separate or interconnected sheet metal pieces. In every sheet metal piece first the port hole 14; 21; 27; 29, which is to form part of the inlet channel of the refrigerant, can be punched and, thereafter, the passage portion can be pressed. Suitably all port holes in every sheet metal piece are punched in the same punching operation and, suitably, the passage portion is shaped in the same pressing operation as the one during which the sheet metal piece is provided with a pressing pattern in its heat transfer portion 15. The punching and pressing operations can be performed in either one or the other order, as mentioned earlier.

What is claimed is:

1. A method of producing heat transfer plates (2), which are of the same size and have central heat transfer portions (15) of the same shape, each of the heat transfer plates (2) having through holes, so called port holes (8, 9; 14; 21; 27; 29), on respective sides of its heat transfer portion (15) for through flow of at least one heat exchange fluid and one passage portion (16; 22; 28; 30, 31, 32) which, when the heat transfer plate (2) abuts against another heat transfer plate in a plate heat exchanger, is adapted to delimit a distribution passage (17; 26) for through flow of said heat exchange fluid and which extends from one (14; 21; 27; 29) of said port holes to an area in or near said heat transfer portion (15), which area has the same position in relation to the heat transfer portion (15) in each of the heat transfer plates (2), separate operations being carried out for pressing the passage portions (16; 22; 28; 30, 31, 32) of said heat transfer plates (2) and for punching the holes which shall form said port holes (8, 9; 14; 21; 27; 29), respectively, comprising providing by said punching operation each one of separate or interconnected sheet metal pieces, which are to form the said heat transfer plates (2), with holes in a way such that said one port hole (14; 21; 27; 29) in a first sheet metal piece becomes of a different kind than the corresponding one port hole (14; 21; 27; 29) in a second sheet metal piece, the said one port holes (14; 21; 27; 29) of the sheet metal pieces being shaped by the punching operation such that they result in finished heat transfer plates (2) having differently sized passage portions (16; 22; 28; 30, 31, 32).

2. A method according to claim 1, in which each sheet metal piece is first subjected to the punching operation for punching said one port hole (14; 21; 27; 29) and thereafter subjected to the pressing operation for shaping the said passage portion (16; 22; 28; 30, 31, 32).

3. A method according to claim 1, in which each sheet metal piece is first subjected to the pressing operation for shaping the said passage portion (16; 22; 28; 30, 31, 32) and thereafter subjected to the punching operation for punching said one port hole (14; 21; 27; 29).

4. A method according to claim 1, in which the said one port holes (14; 21; 27) of different kinds are shaped circular but with different diameters.

5. A method according to claims 1, in which at least one of said one port holes (29, 33, 34) is given a shape differing from circular shape.

6. A method according to claim 1, in which the pressing operation for the shaping of the said passage portion (16; 22; 28; 30, 31, 32) of each of the heat transfer plates (2) is carried out at the same time as the heat transfer portion (15) of this heat transfer plate (2) is provided with a pressing pattern of depressions and elevations.

7. A method according to claim 1, in which the said passage portion of each of the heat transfer plates (2) is shaped so that it forms a groove (16; 28).

8. A method according to claim 1, in which the said passage portion (22) of each of the heat transfer plates (2) is provided with a pressing pattern of elevations and/or depressions (23).

9. An assortment of heat transfer plates (2), which are of the same size and have central heat transfer portions (15) of the same shape, each of the heat transfer plates (2) having through holes, so called port holes (8, 9; 14; 21; 27; 29), on respective sides of its heat transfer portion (15) for through flow of at least one heat exchange fluid and one passage portion (16; 22; 28; 30, 31, 32) which, when the heat transfer plate (2) abuts against another heat transfer plate in a plate heat exchanger, is adapted to delimit a distribution passage (17; 26) for through flow of said heat exchange fluid and which extends from one (14; 21; 27; 29) of said port holes to an area in or near said heat transfer portion (15), which area has the same position in relation to the heat transfer portion (15) in each of the different heat transfer plates, wherein the said one port holes (14; 21; 27; 29) of the heat transfer plates (2) at the respective said passage portions (16; 22; 28; 30, 31, 32) are of different kinds and are shaped such that the passage portions (16; 22; 28; 30, 31, 32) of the heat transfer plates (2) have different sizes.

10. An assortment of heat transfer plates according to claim 9, in which the said passage portions (16; 28; 30, 31, 32) of the respective heat transfer plates (2) form grooves (16; 28; 30, 31, 32) having different lengths.

11. An assortment of heat transfer plates (2) according to claim 9, in which the said passage portions (22) of the respective heat transfer plates (2) are provided with pressing patterns of elevations and/or depressions (23).

12. An assortment of heat transfer plates (2) according to claim 9, in which the said one port holes (14; 21; 27) of different kinds are circular but have different diameters.

13. An assortment of heat transfer plates (2) according to the claim 9, in which at least one of said one port holes (29, 33, 34) of different kinds has a shape differing from circular shape.

14. A plate heat exchanger comprising heat transfer plates (2) of at least one kind being included in an assortment according to any one of the claims 9–13, each of said heat transfer plates (2) having a central heat transfer portion (15), through holes, so called port holes (8, 9; 14; 21; 27; 29), on respective sides of its heat transfer portion (15) for through flow of at least one heat exchange fluid and a passage portion (16; 22; 28; 30; 31; 32), which is adapted to delimit a distribution passage (17; 26) between two adjacent heat transfer plates (2) in a plate heat exchanger for through flow of said heat exchange fluid and which extends from one (14; 21; 27; 29) of said port holes to an area in or near said heat transfer portion (15), which area has the same position in relation to the heat transfer portion (15), in the different heat transfer plates (2), wherein the relationship between the smallest through flow area of said distribution passage (17; 26) and the through flow area of said one port hole (14; 21; 27; 29) is between 0.0002 and 0.05.

15. A plate heat exchanger according to claim 14, wherein the relationship between the smallest through flow area of said distribution passage (17; 26) and the through flow area of said one port hole (14; 21; 27; 29) is between 0.0007 and 0.017.

* * * * *